US010092147B2

(12) United States Patent
Rowntree

(10) Patent No.: US 10,092,147 B2
(45) Date of Patent: Oct. 9, 2018

(54) VACUUM CLEANING DEVICE

(71) Applicant: BLACK & DECKER INC., New Britain, CT (US)

(72) Inventor: David Rowntree, Durham (GB)

(73) Assignee: BLACK & DECKER INC., New Britain, CT (US)

( * ) Notice: Subject to any disclaimer, the term of this patent is extended or adjusted under 35 U.S.C. 154(b) by 0 days.

(21) Appl. No.: 15/829,244

(22) Filed: Dec. 1, 2017

(65) Prior Publication Data

US 2018/0078102 A1 Mar. 22, 2018

Related U.S. Application Data

(63) Continuation of application No. 14/681,199, filed on Apr. 8, 2015, now Pat. No. 9,861,241.

(30) Foreign Application Priority Data

Apr. 11, 2014 (EP) ..... 14164484

(51) Int. Cl.
*A47L 9/14* (2006.01)
*A47L 5/24* (2006.01)
*A47L 9/16* (2006.01)

(52) U.S. Cl.
CPC ..... *A47L 5/24* (2013.01); *A47L 9/1691* (2013.01)

(58) Field of Classification Search
CPC ..... A47L 5/24; A47L 9/1691
See application file for complete search history.

(56) References Cited

U.S. PATENT DOCUMENTS 6,434,785 B1 8/2002 Vandenbelt et al.
6,712,868 B2 * 3/2004 Murphy ..... A47L 5/36 15/352
7,052,523 B2 5/2006 Murphy et al.
7,152,277 B2 * 12/2006 Jung ..... A47L 9/1675 15/352
7,418,763 B2 9/2008 Shaver et al.
8,028,373 B2 * 10/2011 Rowntree ..... A47L 5/24 15/327.1
8,418,936 B2 4/2013 Schaeffer et al.
(Continued)

FOREIGN PATENT DOCUMENTS

GB 2533623 A * 6/2016 ..... A47L 9/00
JP 2004249010 A * 9/2004

OTHER PUBLICATIONS

JP 2004-249010 A—English Machine Translation.*
Canadian Office Action dated Apr. 1, 2016 for Canadian Application No. 2,887,824.

*Primary Examiner* — Marc Carlson
(74) *Attorney, Agent, or Firm* — John Yun

(57) ABSTRACT

A vacuum cleaning device comprises: a housing; a motor and fan assembly for generating an airflow between an air inlet and an air outlet. A removable dirt collection bin receives dirt in the airflow. The dirt collection bin is located in fluid communication between the air inlet and air outlet and mountable to the housing. A locking mechanism is moveable between a locked position and an unlocked position for releasably coupling the dirt collection bin to the housing. An ejection mechanism arranged to eject the dirt collection bin away from the housing when the locking mechanism is in the unlocked position.

14 Claims, 8 Drawing Sheets

(56) References Cited

U.S. PATENT DOCUMENTS

| | | | | |
|---|---|---|---|---|
| 8,578,555 | B2 * | 11/2013 | Conrad | A47L 9/22 15/327.7 |
| 8,595,895 | B2 * | 12/2013 | Smith | A47L 5/24 15/344 |
| 2001/0025395 | A1 * | 10/2001 | Matsumoto | A47L 9/108 15/353 |
| 2004/0200029 | A1 * | 10/2004 | Jin | A47L 9/1675 15/352 |
| 2008/0172821 | A1 * | 7/2008 | Kang | A47L 5/225 15/327.5 |
| 2009/0282639 | A1 * | 11/2009 | Dyson | A47L 5/24 15/344 |
| 2011/0225766 | A1 * | 9/2011 | Xue | A47L 9/1691 15/347 |
| 2012/0222254 | A1 * | 9/2012 | Conrad | A47L 5/28 15/347 |
| 2013/0091654 | A1 * | 4/2013 | Smith | A47L 5/24 15/344 |
| 2013/0091814 | A1 * | 4/2013 | Smith | A47L 9/1633 55/345 |
| 2016/0015230 | A1 * | 1/2016 | Conrad | A47L 5/24 15/344 |

* cited by examiner

VACUUM CLEANING DEVICE

CROSS-REFERENCE TO RELATED APPLICATIONS

This application is a continuation and claims priority to U.S. application Ser. No. 14/681,199 filed Apr. 8, 2015, entitled Vacuum Cleaning Device; and European Patent Application No. 14164484.9 filed Apr. 11, 2014. The entire disclosures of the above applications are incorporated herein by reference.

BACKGROUND OF THE INVENTION

Vacuum cleaners are well known for collecting dust and dirt. Typically, vacuum cleaners are intended for use in a domestic environment, although they also find uses in other environments. Generally vacuum cleaners are electrically powered and comprise an electric motor and a fan connected to an output shaft of the motor, an inlet for dirty air, an outlet for clean air and a collection chamber for dust. A dust filter and/or other separating means is located between the inlet and the collection chamber in order to remove the dirt from the dirty air. Electrical power can be provided by a source of mains electricity or by a replaceable and/or rechargeable battery pack.

In recent times there has been a trend for vacuum cleaners to be battery operated because this removes the need for a power cable and allows the user to use the vacuum cleaner remote from sources of mains electricity. Battery operated vacuum cleaners are often smaller handheld devices which also assist in the portability of the vacuum cleaner. For example, a user can use a battery powered handheld vacuum cleaner in a vehicle well away from any sources of mains electricity.

Typically a handheld vacuum cleaning device is small enough for a user to operate and carry the handheld vacuum cleaning device in one hand. This means that the collection chamber and dust filter are smaller than upright or cylinder vacuum cleaners and the collection chamber and filter requires emptying and cleaning more frequently. One advantage of a handheld vacuum cleaning device having a relatively small collection chamber is that the user can wash the collection chamber under the tap.

It is known to have a handheld vacuum cleaning device with a removeable collection chamber. EP2581013 discloses a dirt collection bowl which is connected to the outer circumferential edge of the housing by e.g. a bayonet fitting and allows the removal of the cyclone assembly when the dirt collection bowl is opened.

A problem with the dirt collection bowl of EP2581013 is that the user may not properly align the dirt collection bowl with the housing of the handheld vacuum cleaning device. If the dirt collection bowl is not correctly aligned, then the air will not be drawn properly into the vacuum cleaning device or the dirt collection bowl can be accidentally knocked off.

A vacuum cleaning appliance which is easier to use and assemble is desired. Embodiments of the present invention aim to address the aforementioned problems.

SUMMARY OF THE INVENTION

According to an aspect of the present invention there is a vacuum cleaning device comprising: a housing; a motor and fan assembly for generating an airflow between an air inlet and an air outlet; a removable dirt collection bin for receiving dirt in the airflow, the dirt collection bin being located in fluid communication between the air inlet and air outlet and mountable to the housing; a locking mechanism moveable between a locked position and an unlocked position for releasably coupling the dirt collection bin to the housing; and an ejection mechanism arranged to eject the dirt collection bin away from the housing when the locking mechanism is in the unlocked position.

This means that the dirt collection bin is easier to remove from the housing because the ejection mechanism moves the bin away from the housing. In this way the dirt collection bin will stand proud of the housing and this makes it easier for the user to remove.

Preferably the ejection mechanism comprises at least one projecting arm engageable with a reciprocal recess in the dirt collection bin. The projecting arms may be pivotally mounted on the housing.

Preferably the ejection mechanism comprises a biasing member urging the dirt collection bin away from the housing. This means that the dirt collection bin is ejected from the housing as soon as the locking mechanism is moved into an unlocked position.

Preferably the dirt collection bin is releasably coupled to the housing such that the dirt collection bin is moveable in a direction substantially transverse to a longitudinal axis of the vacuum cleaning device. Preferably the housing comprises a handle and the dirt collection bin is mountable between the handle and the housing. This means that the dirt collection bin is easier to remove whilst holding a handle of the vacuum cleaning device.

Preferably the ejection mechanism is arranged to urge the dirt collection bin from a coupled position in which the dirt collection bin is lockable with the housing to a decoupled position in which the dirt collection bin projects out from the housing.

Preferably the housing comprises a gripping element which increases friction between the dirt collection bin and the housing when the dirt collection bin is in the decoupled position. This means that the dirt collection bin will not fall out of the housing if the user has orientated the vacuum cleaning device such that the dirt collection bin faces the ground.

Preferably the locking mechanism comprises a first latch portion and a second catch portion. Preferably the first latch portion comprises a plurality of moveable hook elements and the second catch portion comprises a plurality of corresponding reciprocal fixed hook elements. Preferably at least part of the locking mechanism is mounted on a moveable ring member. Preferably the moveable ring member is mounted on the dirt collection bin. Preferably the dirt collection bin has a substantially circular cross section and the ring member is rotatable around the longitudinal axis of the dirt collection bin.

Preferably the at least part of the locking mechanism is mounted on the housing.

Preferably the device comprises an actuating button for actuating the locking mechanism.

Preferably the locking mechanism is moveable between a locked position and an unlocked position and the locking mechanism is biased to the locking position.

BRIEF DESCRIPTION OF THE DRAWINGS

Various other aspects and further embodiments are also described in the following detailed description and in the attached claims with reference to the accompanying drawings, in which:

DETAILED DESCRIPTION OF THE INVENTION

Figure 1:
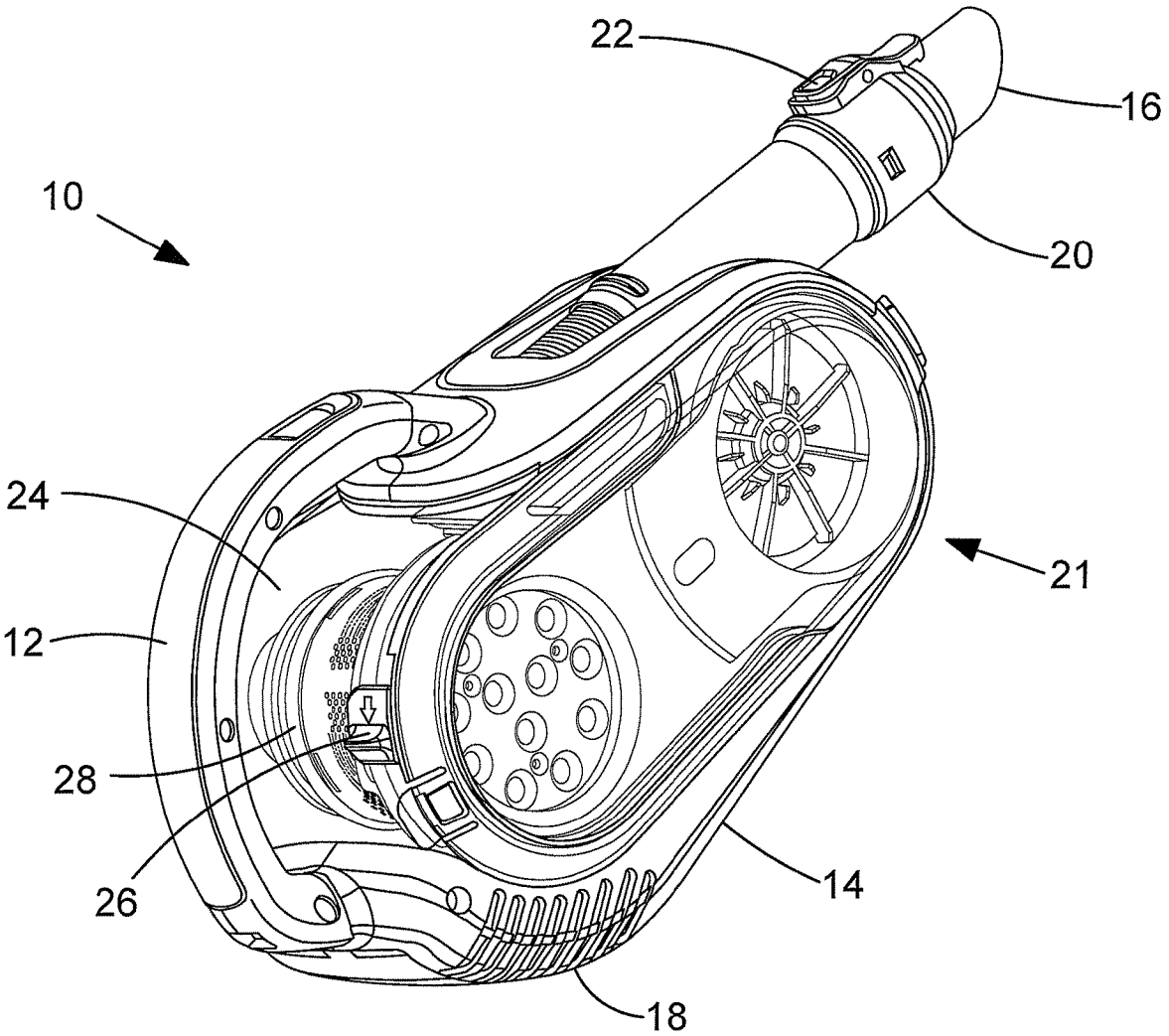
FIG. 1 shows a perspective view of the vacuum cleaning device.

FIG. 1 shows a perspective view of a vacuum cleaning device 10. The vacuum cleaning device 10 is a handheld vacuum cleaning device and the user is able to hold the vacuum cleaning device by a handle 12 during use. The vacuum cleaning device 10 may be any other sort of vacuum cleaning device such as an upright vacuum cleaner, a cylinder vacuum cleaner. In the embodiments discussed hereinafter the vacuum cleaning device 10 is a handheld vacuum cleaning device.

The vacuum cleaning device 10 comprises a housing 14. The housing 14 may comprises a known clamshell arrangement whereby the housing 14 comprises two halves which are fastened together. The housing 14 may comprise additional housing components, such as handle 12, which are attached to the clamshell arrangement.

The housing 14 houses a motor and fan assembly 21 for generating an air flow. The motor and fan assembly draws dirty air from an air inlet 16 and exhausts clean air at an air outlet 18. The air inlet 16 is located in a protruding nozzle 20. The nozzle 20 comprises a coupling mechanism 22 for releasably attaching one or more extensions of cleaning tools (not shown). When an extension or cleaning tool is coupled to the nozzle 20, the cleaning tool is in fluid communication with the nozzle 20 and the air inlet 16 will effectively be at the end of the attached extension or cleaning tool. The air outlet 18 comprises a plurality of holes in the housing 14. The air outlet 18 is orientated so that the clean air is exhaust in a direction away from the air inlet 16.

A removeable dirt collection bin 24 is in fluid communication between the air inlet 16 and the air outlet 18. In this way an air flow path between the air inlet 16 and the air outlet 18 passes through the removeable dirt collection bin 24. The removeable dirt collection bin 24 is releasably coupled to the housing 14 by a locking mechanism 26. FIG. 1 shows the removeable dirt collection bin 24 coupled to the housing 14. This means that the dirt collection bin 24 does not move with respect to the housing 14 if the user attempted to pull the dirt collection bin 24 away from the housing 14.

The dirt collection bin 24 is located between the housing 14 and the handle 12. This means that the centre of mass of the vacuum cleaning device 10 is located in a position such that the user is able to hold the handle with one hand and operate the locking mechanism 26 with the other hand. The dirt collection bin 24 is received in a reciprocal receiving cavity 29 in the housing 14. The dirt collection bin 24 is directional and only fits in the receiving cavity 29 one way.

A separating element 28 is mounted in the dirt collection bin 24. In some embodiments the separating element 28 is a cyclonic separation element with a primary cyclonic separating means and a secondary cyclonic separating means. This means as the dirty air flows through the dirt collection bin 24, dirt is removed from the air flow and deposited in the dirt collection bin 24. Once the air flow has passed entirely through the separating element 28, all of the dirt has been removed from the air flow and the air may be considered to be "clean air".

In some embodiments the separating element 28 alternatively or additionally comprises a filter element (not shown). The filter element is an air permeable barrier, such as a fine mesh or a foam pad which alternatively or additionally removes dirt from the air flow.

Figure 2:
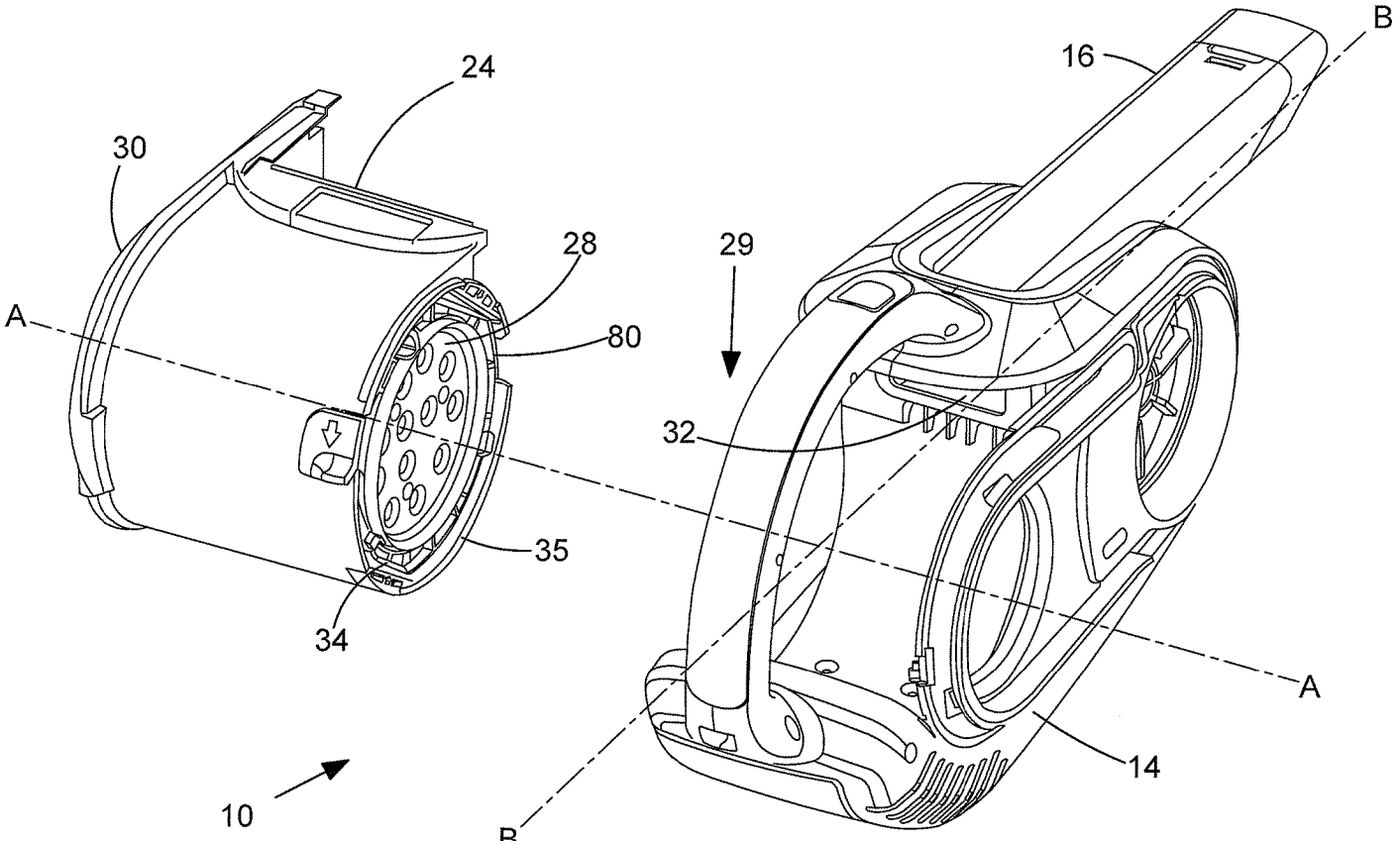
FIG. 2 shows a perspective view of the vacuum cleaning device.

Turning to FIG. 2, which discloses a perspective view of the vacuum cleaning device 10. The removeable dirt collection bin 24 is completely removed from the housing 14. In this arrangement the user is able to remove the dirt collection bin 24 and clean it separately from the housing 14. In particular the user is able to run the dirt collection bin 24 under the tap to clean it. The separating element 28 is removeable from the dirt collection bin 24 so that the separating element 28 and the dirt collection bin may be separately cleaned. The dirt collection bin 24 comprises a substantially cylindrical shape. In some embodiments the dirt collection bin 24 has a substantially circular cross section. In other embodiments the dirt collection bin 24 can be any suitable shape. The dirt collection bin 24 comprises a longitudinal axis A and the dirt collection bin 24 is moveable along a path parallel or coaxial to the longitudinal axis A. The longitudinal axis A of the dirt collection bin 24 is substantially transverse to a longitudinal axis B of the vacuum cleaning device 10. In particular the dirt collection bin 24 is moveable in a direction which is substantially perpendicular to the longitudinal axis B of the vacuum cleaning device 10.

The dirt collection bin 24 also comprises a door 30 which is openable and exposes the underside of the separating element 28. Dirt collects adjacent the openable door 30 and the openable door 30 also provides a convenient way to remove the most of the dirt from the dirt collection bin 24. The openable door 30 can be accessed and opened when the dirt collection bin 24 is coupled to the housing 14 and/or when the dirt collection bin is uncoupled from the housing 14.

The housing 14 comprises a nozzle air outlet 32 in fluid communication with the nozzle 20. The nozzle air outlet 32 outputs dirty air drawn up from the air inlet 16 of the nozzle 20 into the dirt collection bin 24. Clean air is outputted from the dirt collection bin 24 at an open end 34 of the dirt collection bin 24 to the air outlet 18. The open end 34 is the opposite end of the dirt collection bin 24 to the openable door 30.

The vacuum cleaning device 10 comprises at least one air tight seal 35 between the dirt collection bin 24 and the housing 14. Additional seals (not shown) may be provided at the join between the dirt collection bin 24 and the housing 14. The air tight seals ensure that air does not escape between the housing 14 and the dirt collection bin 24 when the dirt collection bin 24 is coupled to the housing 14.

Figure 3:
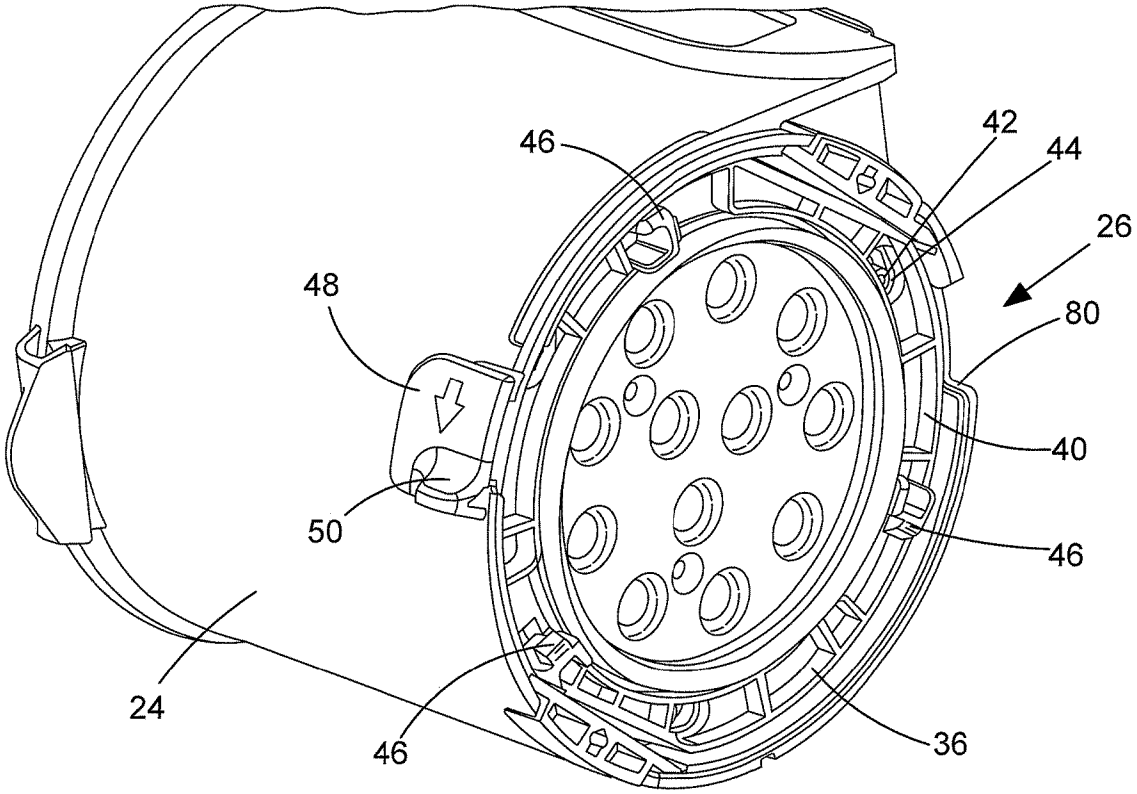
FIG. 3 shows a partial perspective view of the dirt collection bin.
Figure 4:
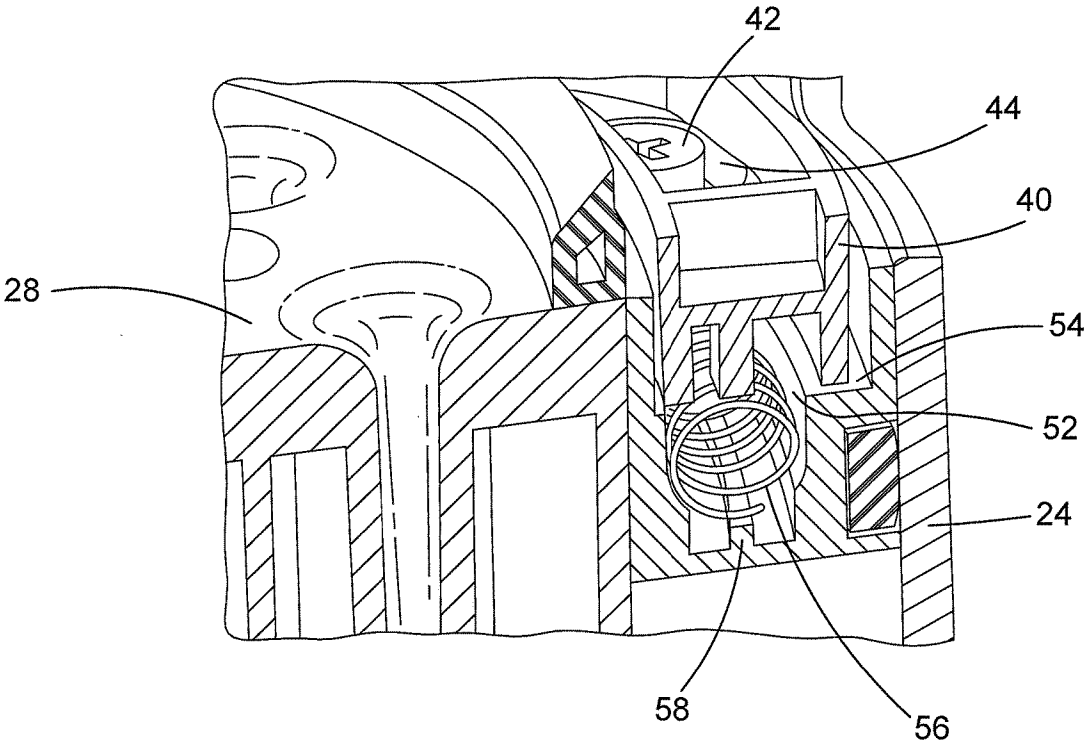
FIG. 4 shows a cross sectional view of a portion of the vacuum cleaning device.
Figure 5:
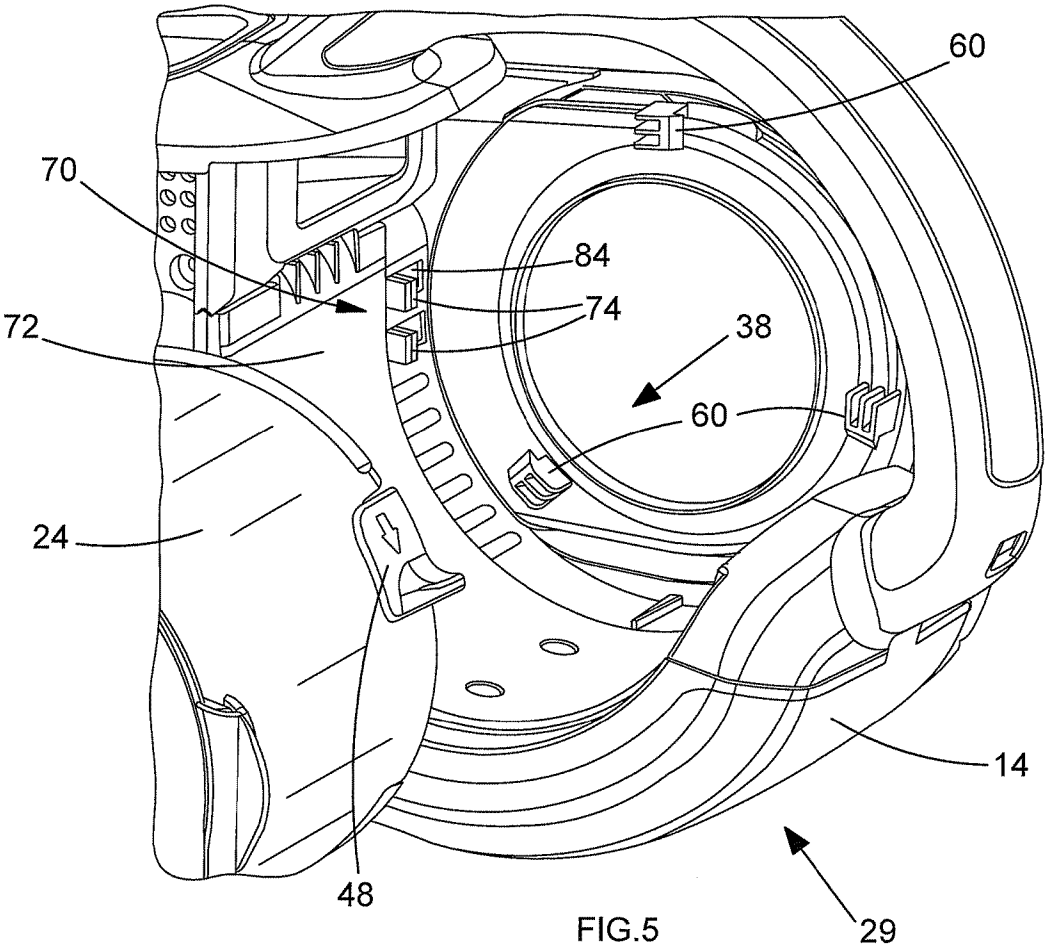
FIG. 5 shows a partial perspective view of the housing of the vacuum cleaning device.

The locking mechanism 26 will now be discussed in further detail in reference to FIGS. 3, 4 and 5. FIG. 3 discloses a partial perspective view of the dirt collection bin 24. FIG. 4 discloses a partial cross sectional view of the edge of the dirt collection bin 24. FIG. 5 discloses a partial perspective view of the housing 14 and the dirt collection bin 24. The locking mechanism 26 may be any suitable means for locking the dirt collection bin 24 to the housing 14. In some embodiments, not shown in the figures, the locking mechanism may be a bayonet type fitting with a projecting bayonet on the dirt collection bin 24 and a reciprocal slot on the housing 14.

Returning to FIG. 3, a first part 36 of the locking mechanism 26 is mounted on the dirt collection bin 24 and a second part 38 of the locking mechanism 26 is mounted on the housing 14. The first part 36 is a moveable latch and the second part 38 is a catch. The first part 36 is a rotatable ring 40 mounted to the dirt collection bin 24 and rotatable about the longitudinal axis A thereof. The rotatable ring 40 is rotatably mounted to the dirt collection bin 24 in an annular channel 52 (as shown in FIG. 4) by screws 42 located in slots 44 of the rotatable ring 40. The rotatable ring 40 rests on an annular shoulder 54 portion of the annular channel 52. The slots 44 are arcuate and determine the extent to which the rotatable ring 40 is permitted to rotate with respect to the dirt collection bin 24. There are a plurality of screws 42 and slots 44 circumferentially located around the rotatable ring 40. Any number of screws 42 and slots 44 can be used to mount the rotatable ring 40 to the dirt collection bin 24. Alternatively in other embodiments any other suitable means can be used to mount the rotatable ring 40 to the dirt collection bin 24 and still permit rotation of the rotatable ring with respect to the dirt collection bin 24.

The rotatable ring 40 is biased to a locking position by spring 56 located in the bottom 58 of the annular channel 52. The spring 56 is coupled to the rotatable ring 40 and a portion of the dirt collection bin 24. The rotatable ring 40 is configured to snap back to the locking position when the user rotates the rotatable ring 40 into the unlocked position and releases the rotatable ring 40.

Returning to FIG. 3, moveable hooks 46 project upwards from the rotatable ring 40. The moveable hooks are integral with the rotatable ring 40 and move when the rotatable ring 40 moves. Rotation of the rotatable ring 40 is achieved with a user operated actuator 48. The actuator 48 comprises an upstanding thumb portion 50 for the user to press.

The second part 38 of the locking mechanism 26 is shown in more detail in FIG. 5. In some embodiments the second part 38 comprises a plurality of fixed hooks 60 which are fixed with respect to the housing. The fixed hooks 60 are integral with the housing 14. The fixed hooks 60 are upstanding from the housing 14 in the direction of the longitudinal axis A of the dirt collection bin 24. The fixed hooks are configured to engage with the moveable hooks 46 in the locking position. In some alternative embodiments the fixed hooks are replaced with reciprocal recesses in the housing 14 for receiving the moveable hooks 46.

Figure 6:
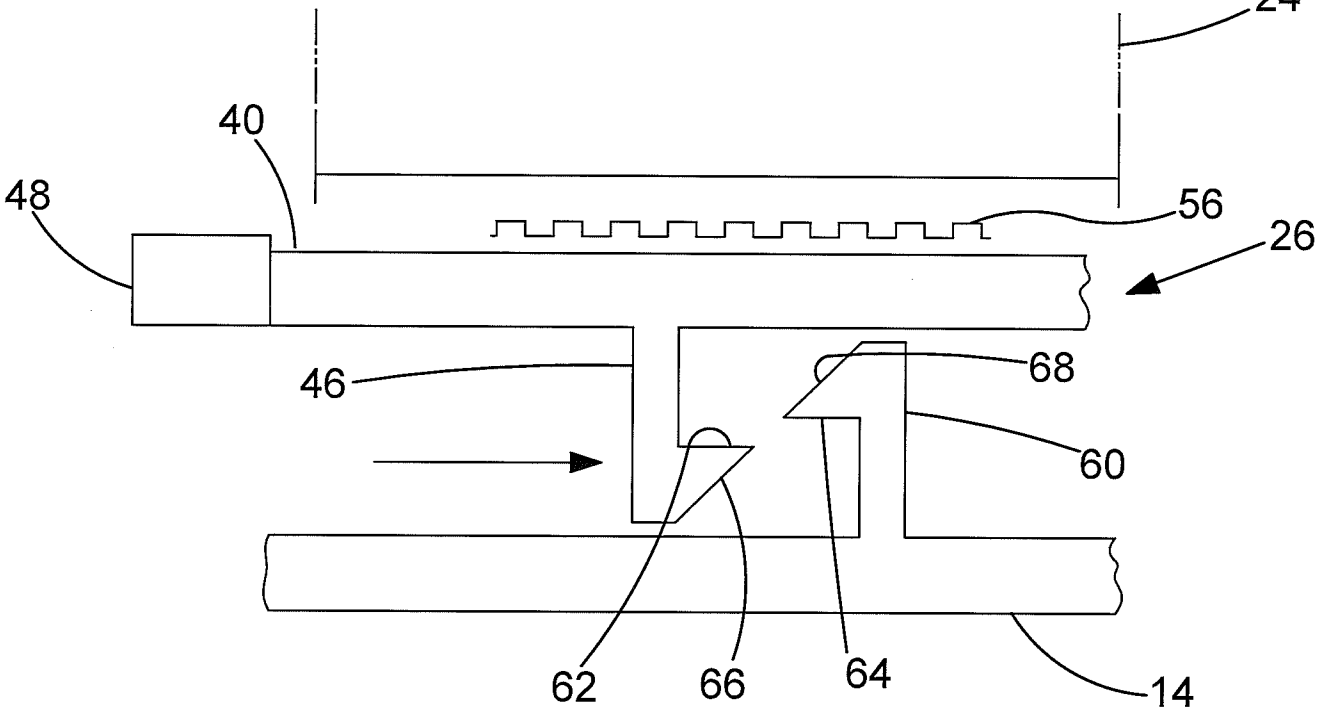
FIG. 6 shows a schematic view of the vacuum cleaning device.

The engagement of the fixed hooks 60 and the moveable hooks 46 will be discussed in more detail in reference to FIG. 6. FIG. 6 is a schematic close up representation of a portion of the locking mechanism 26. A part of the rotatable ring 40 is shown with an integral moveable hook 46. The rotatable ring 40 as shown in FIG. 6 is in the unlocked position with the dirt collection bin 24 adjacent to the housing 14. In this position the moveable hook 40 is free from engagement with the fixed hook 60. In the unlocked position the dirt collection bin 24 is moveable along the longitudinal axis A. As the rotatable ring is moved in the unlocked position, the spring 56 is compressed and this urges the rotatable ring 40 into the locked position as shown by the arrow in FIG. 6.

The moveable hook 45 and the fixed hook respectively have flat abutment surfaces 62, 64. In the locked position flat abutment surfaces 62, 64 of the moveable hook 46 and the fixed hook 60 are in engagement with each other. This means that the hooks 46, 60 are interlocking and the dirt collection bin 24 is coupled to the housing 14. Even if the user pulls the dirt collection bin 24, the interlocking hooks 46, 60 will prevent the dirt collection bin 24 separating from the housing 14.

Both the moveable hook 46 and the fixed hook 60 comprise chamfered surfaces 66, 68 respectively. When the dirt collection bin 24 is inserted (e.g. towards the housing along the longitudinal axis A) into the housing 14, the chamfered surfaces 66, 68 engage. Once the chamfered surfaces 66, 68 are in engagement and the dirt collection bin 24 is pushed closer to the housing 14, the rotatable ring 40 and the moveable hook 46 are rotated with respect to the dirt collection bin 24. The chamfered surface 68 of the fixed hook 60 provides a camming surface to effect movement of the moveable hook 45. Once the chamfered surface 66 of the moveable hook 46 has cleared the fixed hook 60, the rotatable ring 40 snaps back into the locked position and the flat abutment surfaces 62, 64 reengage. In the arrangement shown in FIG. 6, the moveable hook 46 will snap towards the fixed hook 60 if the user does not hold the actuator 48. This means that the locking mechanism 26 will automatically lock the dirt collection bin 24 to the housing 14 when the user reassembles the dirt collection bin 24 and the housing 14.

In some embodiments the moveable first portion 36 of the locking mechanism is mounted on the housing 14 and the fixed second portion 38 of the locking mechanism 26 is mounted on the dirt collection bin 24.

FIG. 5 shows part of an ejection mechanism 70 for ejecting the dirt collection bin 24 out of the housing 14. In some embodiments, the ejection mechanism 70 urges the dirt collection bin in a direction along or parallel to the longitudinal axis A of the dirt collection bin 24. However when the locking mechanism 26 is in the locking position and the dirt collection bin 24 is coupled to the housing 14, the ejection member 70 is not able to eject the dirt collection bin 24. Once the locking mechanism 26 is moved into the unlocked position, the ejection mechanism 70 moves the dirt collection bin 24 out from the housing 14.

The ejection mechanism 70 projects from a wall 72 of the housing 14. The wall 72 faces the dirt collection bin 24 when the dirt collection bin 24 is coupled to the housing 14 in the receiving cavity 29. The ejection mechanism comprises at least one projecting arm 74 which is configured to engage with a reciprocal recess 80 in the dirt collection bin 24. The reciprocal recess 80 is shown in FIG. 3 and comprises a cut out of the wall adjacent the open end 34. FIG. 5 shows a non-limiting example of two projecting arms 74, but any number of projecting arms 74 may be used.

Figure 7:
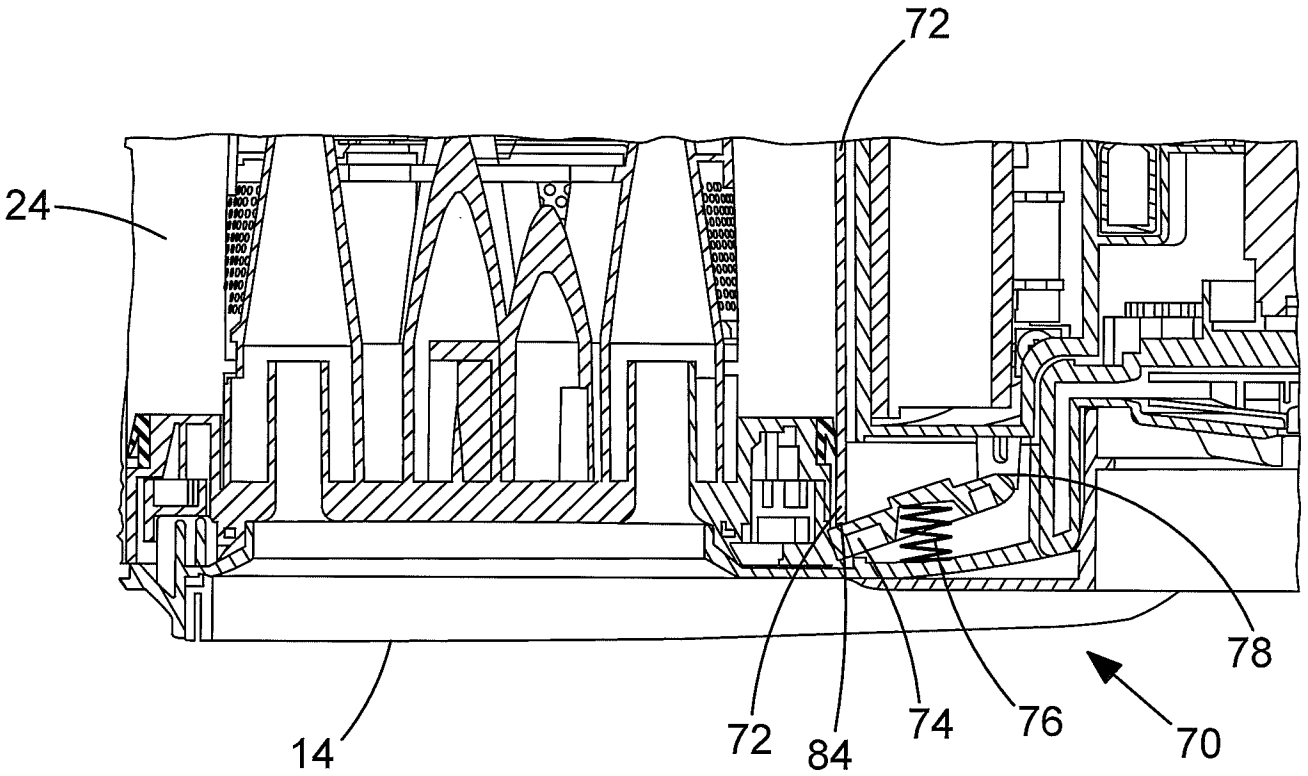
FIG. 7 shows a cross sectional view of the vacuum cleaning device.
Figure 8:
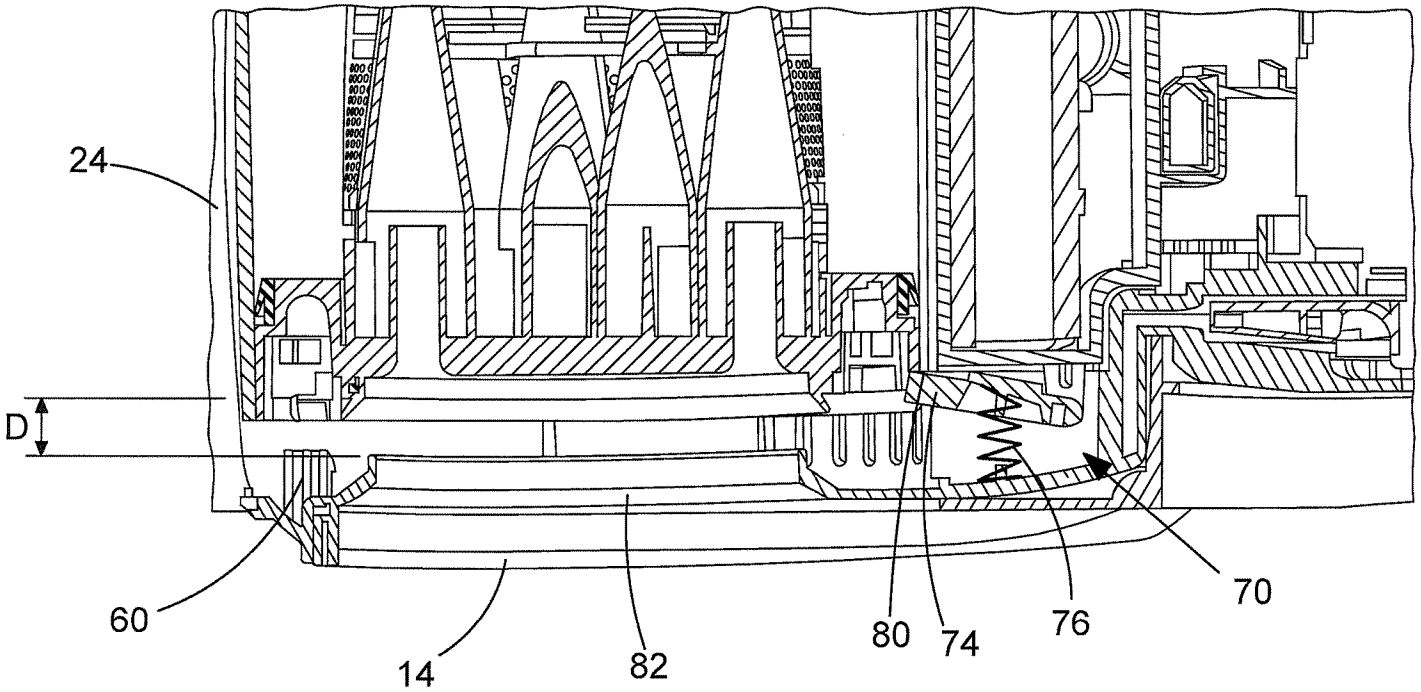
FIG. 8 shows a cross sectional view of the vacuum cleaning device.

The ejection mechanism 70 will now be discussed in further detail with respect to FIGS. 7 and 8. FIGS. 7 and 8 disclose a partial cross sectional view of the vacuum cleaning device 10 when the locking mechanism 26 is in the locked position and the unlocked position respectively.

The ejection mechanism 70 may comprise a biasing member 76 which exerts a force between the housing 14 and the projecting arms 74. The biasing member 76 may be a spring, an elastomeric element or any other suitable means for urging the dirt collection bin 24 away from the housing 14. In some embodiments the biasing member 76 is not used and is replaced with a user operated ejection button (not shown). The user operated ejection button is mechanically coupled to the projecting arms and movement of the projecting arms is caused by moving the user operated ejection button.

The projecting arms 74 of the ejection mechanism 70 are pivotally mounted on the housing 14 at pivot 78. The projecting arms 74 protrude through the wall 72 and engage in a recess 80 in the dirt collection bin 24. In FIG. 7 the locking mechanism 26 is in the locked position and the ejection mechanism 70 is primed ready to push the dirt collection bin 24. The ejection mechanism 70 is only actuated when the user operates the actuator 48 of the locking mechanism 26. In some alternative embodiments the projecting arms 74 are slidably mounted in the housing 14.

Once the locking mechanism 26 is unlocked, the ejection mechanism 70 is activated. This is shown in FIG. 8. The biasing member 76 of the ejection mechanism 70 decompresses and this exerts a force between the projecting arms 74 and the housing 14. The biasing member 76 forces the projecting arms 74 to pivot and move away from the bottom wall 82 housing 14. As the projecting arms 74 move away from the bottom wall 82 of the housing 14, the dirt collection bin 24 is pushed out of the housing 14. The amount of travel of the projecting arms 74 is limited by a stop member. In some embodiments the stop member is determined by a slot 84 in the wall 72 but can be any suitable means for limiting the travel of the projecting arms 74.

When the dirt collection bin 24 has been ejected from the housing 14, the dirt collection bin 24 is in a decoupled position. In the decoupled position the dirt collection bin 24 can be manually removed from the housing 14. However at least a portion of the dirt collection bin 24 is still in contact with the housing 14 in the receiving cavity 29. In the decoupled position or when the dirt collection bin 24 has been completely removed, the projecting arms 24 are located at a further distance along the longitudinal axis A away from the bottom wall 82 of the housing 14 than the chamfered surface 68 of the fixed hooks 60. This is shown by distance D in FIG. 8. This means that the projecting arms 74 engage with the recess 80 of the dirt collection bin 24 before the first part 36 and the second part 38 of the locking mechanism engage with each other when the reassembling the vacuuming cleaning device.

In this way the dirt collection bin 24 stands proud of the housing when the ejection mechanism 70 has forced the dirt collection bin 24 out of the housing 14. This means the dirt collection bin 24 is easier to remove from the housing 14. Furthermore, the dirt collection bin 24 only sits adjacent to the housing 14 and is correctly assembled when the dirt collection bin 24 has been fully inserted into the housing 14 such that the locking mechanism 26 returns to the locking position. If the dirt collection bin 24 has only been partially inserted into the housing 14, the ejection mechanism 70 will force the dirt collection bin 24 back out of the housing 14 before the locking mechanism can engage. This means it is very clear to the user whether the dirt collection bin 24 has been inserted correctly into the housing 14. The user will also know when the dirt collection bin 24 has been correctly inserted because the locking mechanism 26 will snap into the locking mechanism with an audible "click".

In some embodiments there is an optional gripping element increasing friction between the dirt collection bin and the housing when the dirt collection bin 24 is in the decoupled position. In some embodiments the gripping element is the internal wall 72 of the housing 14 which provides a frictional fit with the dirt collection bin 24 when the dirt collection bin has been ejected from the housing 14. The frictional fit is such that the ejection mechanism 70 can push the bin 24 out, but there is not a lose fit between the housing 14 and the bin 24. The gripping element is configured to prevent the dirt collection bin 24 from dropping out of the housing 14 without the user actively pulling the dirt collection bin 24 away from the housing 14. This means that if the user holds the handle 12 with one hand, and then actuates the locking mechanism 26 with the other hand, the bin 24 will not drop on to the floor. In some alternative embodiments the gripping element is a rubber element (not shown) which engages the bin 24 when the bin 24 has been ejected from the housing 14.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A hand-held vacuum cleaning device comprising:

a housing having a front, a back, a top and two side portions, the housing defining a chamber;

a nozzle extending forwardly of a front portion of the housing;

a handle mounted at a top portion of the housing;

a motor and fan assembly located inside the housing for generating an airflow between an air inlet and an air outlet;

a removable dirt collection bin for receiving dirt in the airflow, the dirt collection bin being located in fluid communication between the air inlet and air outlet and mountable within the housing chamber through one of the two side surfaces;

a locking mechanism moveable between a locked position and an unlocked position for releasably coupling the dirt collection bin to the housing;

an ejection mechanism arranged to eject the dirt collection bin away from the housing through one of the side portions of the housing.

2. The hand-held vacuum cleaning device according to claim 1 wherein the ejection mechanism comprises at least one projecting arm engageable with a reciprocal recess in the dirt collection bin.

3. The hand-held vacuum cleaning device according to claim 1 wherein the ejection mechanism comprises a biasing member urging the dirt collection bin away from the housing.

4. The hand-held vacuum cleaning device according to claim 1 wherein the housing has a longitudinal axis parallel with an air inlet nozzle; and the dirt collection bin is releasably coupled to the housing such that the dirt collection bin is moveable in a direction substantially transverse to the longitudinal axis.

5. The hand-held vacuum cleaning device according to claim 1 wherein the dirt collection bin is mountable between the handle and the housing.

6. The hand-held vacuum cleaning device according to claim 1 wherein the ejection mechanism is arranged to urge the dirt collection bin from a coupled position in which the dirt collection bin is lockable with the housing to a decoupled position in which the dirt collection bin projects out from the housing.

7. The hand-held vacuum cleaning device according to claim 1 wherein the locking mechanism comprises a first latch portion and a second catch portion.

8. The hand-held vacuum cleaning device according to claim 7 wherein the first latch portion comprises a plurality of moveable hook elements and the second catch portion comprises a plurality of corresponding reciprocal fixed hook elements.

9. A hand-held vacuum cleaning device comprising:

a housing having a front, a back, a top and two side portions, the housing defining a chamber;

a handle mounted on the housing;

a motor and fan assembly located inside the housing for generating an airflow between an air inlet and an air outlet;

a removable dirt collection bin for receiving dirt in the airflow, the dirt collection bin being located in fluid communication between the air inlet and air outlet and mountable within the housing chamber through one of the two side surfaces;

a locking mechanism moveable between a locked position and an unlocked position for releasably coupling the dirt collection bin to the housing;

an ejection mechanism arranged to eject the dirt collection bin away from the housing through one of the side portions of the housing;

wherein the ejection mechanism is arranged to urge the dirt collection bin from a coupled position in which the dirt collection bin is lockable with the housing to a decoupled position in which the dirt collection bin projects out from the housing; and wherein the housing comprises a gripping element which increases friction between the dirt collection bin and the housing when the dirt collection bin is in the decoupled position.

10. A hand-held vacuum cleaning device comprising:

a housing having a front, a back, a top and two side portions, the housing defining a chamber;

a handle mounted on the housing;

a nozzle extending from the front portion of the housing, the nozzle including an air inlet;

a motor and fan assembly located inside the housing for generating an airflow between the air inlet and an air outlet;

a removable dirt collection bin for receiving dirt in the airflow, the dirt collection bin being located in fluid communication between the air inlet and air outlet and mountable within the housing chamber;

a locking mechanism moveable between a locked position and an unlocked position for releasably coupling the dirt collection bin to the housing;

an ejection mechanism arranged to eject the dirt collection bin away from the housing; and wherein at least part of the locking mechanism is mounted on a moveable ring member that extends around a perimeter of the dirt collection bin.

11. The hand-held vacuum cleaning device according to claim 10 wherein the dirt collection bin comprises a substantially circular cross section and the moveable ring member is rotatable around the longitudinal axis of the dirt collection bin.

12. The hand-held vacuum cleaning device according to claim 10 wherein the at least part of the looking mechanism is mounted on the housing.

13. The hand-held vacuum cleaning device according to claim 10 wherein the device comprises an actuating button for actuating the locking mechanism.

14. The hand-held vacuum cleaning device according to claim 10 wherein the locking mechanism is biased to the locking position.

* * * * *